United States Patent [19]

Voss et al.

[11] Patent Number: 4,865,113

[45] Date of Patent: Sep. 12, 1989

[54] COUNTERGRAVITY CASTING APPARATUS AND PROCESS FOR CASTING THIN-WALLED PARTS

[75] Inventors: Karl D. Voss, Standish; James B. Mercer, Saginaw; Gary F. Ruff, Farmington Hills, all of Mich.

[73] Assignee: General Motors Corporation, Detroit, Mich.

[21] Appl. No.: 238,724

[22] Filed: Aug. 30, 1988

[51] Int. Cl.[4] ..... B22D 18/06

[52] U.S. Cl. ..... 164/63; 164/134; 164/255; 164/256; 164/358

[58] Field of Search ..... 164/63, 255, 256, 134, 164/358

[56] References Cited

U.S. PATENT DOCUMENTS

| | | | |
|---|---|---|---|
| 2,379,401 | 6/1945 | Poulter | 164/55 |
| 2,908,054 | 10/1959 | Wilkins | 164/255 |
| 3,893,917 | 7/1975 | Pryor et al. | 164/134 X |
| 3,981,352 | 9/1976 | Nurminen et al. | 164/358 |
| 4,112,997 | 9/1978 | Chandley | 164/119 |
| 4,340,108 | 7/1982 | Chandley et al. | 164/63 |
| 4,606,396 | 8/1986 | Chandley et al. | 164/255 |
| 4,690,196 | 9/1987 | Vernay | 164/58.1 |

*Primary Examiner*—Nicholas P. Godici

*Assistant Examiner*—J. Reed Batten, Jr.

*Attorney, Agent, or Firm*—Reising, Ethington, Barnard, Perry & Milton

[57] ABSTRACT

Apparatus for the vacuum-assisted, countergravity casting of thin-walled metal parts includes a plurality of expendable casting molds supported on a top side of a reusable drag slab. Each casting mold includes a mold cavity and a mold ingate passage extending from the mold cavity into registry with a respective underlying slab ingate passage that extends between the top side and a bottom side of the drag slab and that optionally includes a molten metal filter therein. When the bottom side of the drag slab is immersed in an underlying molten metal pool with the mold cavities evacuated, the molten metal is drawn upwardly through each slab ingate passage and the molten metal filter therein and then through each mold ingate passage registered therewith into each mold cavity. The molten metal filter in each slab ingate passage removes inclusion-forming impurities from the molten metal as it is drawn upwardly into each mold cavity. The presence of objectionable, non-metallic inclusions that can adversely affect part performance is thereby minimized in the thin-walled parts cast in the molds. The drag slab can be reused in the casting of successive sets of expendable casting molds.

26 Claims, 2 Drawing Sheets

COUNTERGRAVITY CASTING APPARATUS AND PROCESS FOR CASTING THIN-WALLED PARTS

FIELD OF THE INVENTION

The invention relates to the vacuum-assisted, countergravity casting of molten metal and, in particular, to an improved apparatus and method for the vacuum-assisted, countergravity casting of a plurality of thin-walled metal parts, especially thin-walled metal parts substantially free of harmful non-metallic inclusions that can adversely affect part performance.

BACKGROUND OF THE INVENTION

A vacuum-assisted, countergravity casting process of the mold immersion type is described in such prior patents as the Chandley et al U.S. Pat. Nos. 4,340,108 issued July 20, 1982, and 4,606,396 issued Aug. 19, 1986. That countergravity casting process involves providing a mold having an expendable porous, gas permeable upper mold member (cope) and an expendable lower mold member (drag) engaged together, sealing the bottom lip of a vacuum chamber to the mold such that the vacuum chamber confronts the gas permeable upper mold member, submerging the bottom side of the lower mold member in an underlying molten metal pool and evacuating the vacuum chamber to urge the molten metal upwardly through one or more ingate passages in the lower mold member and into one or more mold cavities formed between the upper and lower mold members. Initial solidification of the molten metal is typically effected in the mold ingate passages, which are sized to this end, to permit withdrawal of the mold from the molten metal pool even through the metal filling the mold cavities may still be molten and unsolidified. In this way, the overall casting cycle time is significantly reduced. The above-described vacuum-assisted, countergravity casting process has been characterized by high production rates and high yields, especially in the casting of thin-walled parts (e.g., cast parts having a wall thickness of 0.5 inch or less), and has provided designers of cast parts with the opportunity and incentive to become more aggressive in calling for thin-walled cast parts as a means of reducing part weight.

Such expendable countergravity casting molds are complex in that in addition to the mold cavities themselves, they also require sealing surfaces thereon as well as means for securing the molds to the vacuum chamber. They are typically relatively expensive (e.g., compared to green sand molds) in that they require more expensive materials (e.g., resin-sand mixtures and curing agents therefor).

Moreover, the inventors have discovered that as the wall thickness of some parts cast in such molds is reduced to lower part weight, the presence of minute, non-metallic inclusions (e.g., non-metallic inclusions less than 0.010 inch diameter) in the microstructure become more significant and are deleterious to the mechanical properties (e.g., strength) and performance of the cast part.

This capability of such minute inclusions to adversely affect the mechanical properties and performance of thin-walled cast parts made by the above-described casting process has not only inhibited to some extent use of this casting process but also has placed an additional burden on the casting inspection equipment and procedures of the foundry. In particular, such minute inclusions typically cannot be detected in thin-walled cast parts using conventional x-ray equipment heretofore used. As a result, more sophisticated and costly defect analysis equipment, such as tomography or real time, high sensitivity x-ray analysers, must be used in an attempt to detect the presence of such harmful inclusions in the cast part. The cost of producing acceptable, thin-walled cast parts is thus increased.

In order to take full advantage of the vacuum-assisted, countergravity casting process described hereinabove in the casting of thin-walled parts, there is a need to reduce the costs of the process and to minimize the presence of objectionable inclusions in the resulting cast parts without adversely affecting the high production rates and yields achievable with this casting process.

It is an object of the present invention to provide an improved vacuum-assisted, countergravity casting apparatus and process that satisfies these needs.

It is another object of the invention to provide an improved vacuum-assisted, countergravity casting apparatus and process that enable the casting of a plurality of thin-walled parts without compromising the mechanical properties and performance of the cast parts in service.

It is still another object of the invention to provide a vacuum-assisted, countergravity casting apparatus and process for simultaneously casting a plurality of thin-walled metal parts in expendable casting molds carried on a common drag slab that is immersible in an underlying molten metal pool during casting and that includes an individual slab ingate passage cooperatively registering with one or more mold ingate passages in each casting mold for supplying molten metal to each casting mold in controlled manner from the underlying molten metal pool.

It is still another object of the invention to provide a vacuum-assisted, countergravity casting apparatus and process of the preceding paragraph wherein each slab ingate passage preferably includes molten metal filtering means therein for removing inclusion-forming impurities from the molten metal as it is drawn upwardly into each casting mold to minimize the presence of harmful inclusions in the cast part that can adversely affect part performance.

SUMMARY OF THE INVENTION

The invention contemplates apparatus for the vacuum-assisted, countergravity casting of molten metal comprising (a) a drag slab (preferably reuseable) having a bottom side for immersion in an underlying pool of molten metal, a top side and a slab ingate passage between the bottom side and the top side, (b) at least one expendable casting mold on the top side of the drag slab overlying the slab ingate passage, said casting mold including a bottom side supported on the top side of the drag slab, a mold cavity therein and one or more mold ingate passage(s) disposed between the mold cavity and the bottom side of the mold and registering with the underlying slab ingate passage for receiving molten metal therefrom, (c) means for relatively moving the drag slab and the molten metal pool to immerse the bottom side of the drag slab in the molten metal to position the slab ingate passage in the pool, and (d) means for evacuating the mold Cavity of the casting mold when the bottom side of the drag slab is immersed in the pool to urge the molten metal upwardly through the slab ingate passage and through the mold ingate passage registered therewith into the mold cavity to fill same with the molten metal.

The invention also contemplates an apparatus of the preceding paragraph having molten metal filtering means disposed in the slab ingate passage to remove inclusion-forming impurities from the molten metal drawn upwardly into the mold cavity and thereby minimize the presence of harmful inclusions in the cast part that can adversely affect its mechanical properties and performance in service.

In one embodiment of the invention, each casting mold includes a drag portion supported on the top side of the drag slab and a porous, gas permeable cope portion disposed atop the drag portion with a mold cavity defined at least in part in the cope portion. The drag portion of each casting mold includes a plurality of mold ingate passages registered with a respective underlying slab ingate passage having a molten metal filter therein. The mold ingate passages are sized to effect initial solidification of the molten metal therein before the molten metal solidifies in the mold cavities to permit withdrawal of the drag slab from the molten metal pool shortly after mold filling.

In another embodiment of the invention, a vacuum chamber is sealingly disposed on the drag slab so as to confront the casting mold for evacuating the mold cavity through the gas permeable cope portion thereof.

In still another embodiment of the invention, a molten metal sump is disposed between the molten metal filter in the slab ingate passage and the mold cavity positioned thereabove in the casting mold to provide an even (substantially constant), uninterrupted, controlled molten metal flow to each mold cavity in spite of gradual plugging of the filter with inclusion-forming impurities removed from the molten metal as it is drawn upwardly into the mold cavity.

The invention also contemplates a method of vacuum-assisted, countergravity casting of molten metal comprising (a) positioning a casting mold on the top side of a drag slab with the casting mold overlying a slab ingate passage extending between the top side and a bottom side of the drag slab, (b) registering a mold ingate passage of the casting mold with the slab ingate passage for supplying molten metal to a mold cavity disposed in the casting mold above the mold ingate passage, (c) relatively moving the drag slab and an underlying molten metal pool to immerse the bottom side of the drag slab therein to position the slab ingate passage in the pool and (d) evacuating the mold cavity of the casting mold sufficiently to urge the molten metal upwardly through the slab ingate passage and through the mold ingate passage registered therewith into the mold cavity. Typically, after the casting mold is filled with the molten metal and the drag slab is removed from the molten metal pool, the metal-filled casting mold and the drag slab are separated so that a new empty casting mold can be positioned on the same drag slab for countergravity casting. Moreover, in a preferred embodiment, the molten metal is filtered as it is drawn upwardly through the slab ingate passage to remove impurities from the molten metal that could cause harmful inclusions in the cast part formed in the mold cavity.

The invention may be better understood when considered in the light of the following detailed description of certain specific embodiments thereof which is given hereafter in conjunction with the following drawings.

DETAILED DESCRIPTION OF THE INVENTION

Figure 1:
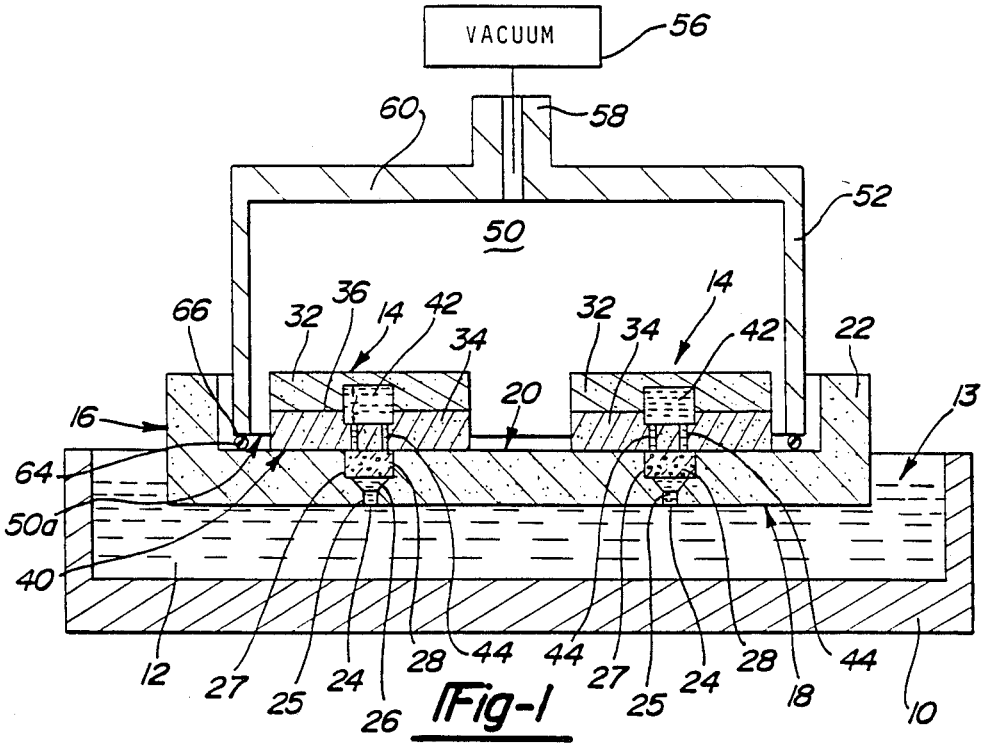
FIG. 1 is a sectioned elevational view showing one embodiment of the casting apparatus of the invention with a set of casting molds positioned on the top side of the drag slab and the bottom side of the drag slab immersed in an underlying molten metal pool for casting.

In the drawings, like reference numerals are used for like parts or features in all of the figures. Referring to FIG. 1, a vacuum-assisted, countergravity casting apparatus in accordance with one embodiment of the invention is illustrated as including a container 10 of molten metal 12 to be countergravity cast into a plurality of expendable casting molds 14 laterally (horizontally) spaced apart on a common, reusable drag slab 16.

The drag slab 16 includes a horizontal, flat bottom side 18 adapted for immersion in the molten metal pool 13 (formed by the molten metal 12 contained in the container 10), a horizontal, flat top side 20 having an upstanding levee 22 around the periphery thereof and a plurality of laterally (horizontally) spaced apart, non-intersecting (substantially parallel) slab ingate passages 24 extending between the bottom and top sides 18,20 for supplying the molten metal 12 to a respective casting mold 14 disposed thereabove. Each slab ingate passage 24 includes a lower cylindrical passage portion 25, an intermediate diverging portion 26 and an upper, enlarged seat or pocket 27 opening to the top side 20 of the drag slab 16. Received in each seat 27 is a perforate, ceramic, molten metal filter 28. Typically, each ceramic filter 28 is adhesively secured (glued) in a respective recessed seat 27 of the drag slab 16.

Figure 2:
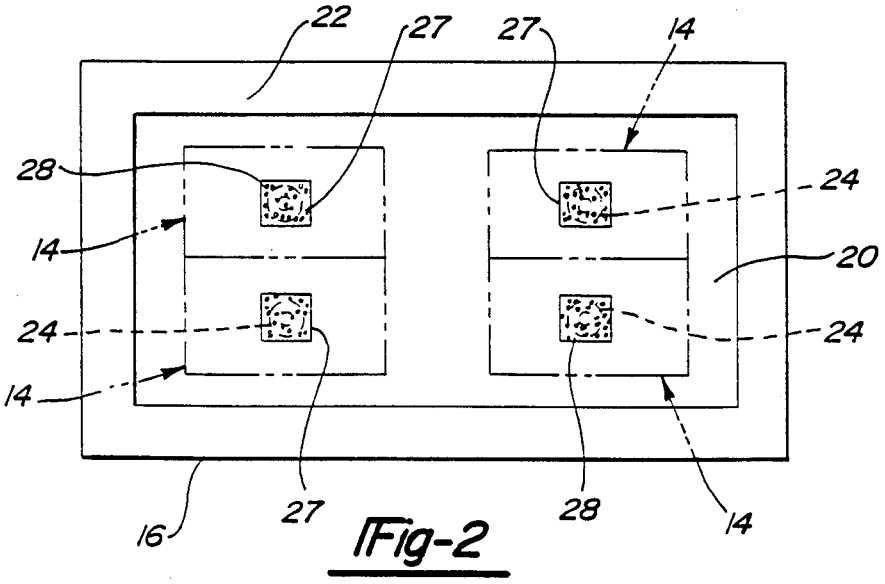
FIG. 2 is a plan view of the drag slab showing a molten metal filter in each slab ingate passage. The casting molds are shown in phantom on the drag slab.

As shown best in FIG. 2, the slab ingate passages 24 and the ceramic filters 28 inserted in the recessed seats 27 are arranged in a generally rectangular pattern on the drag slab 16.

The drag slab 16 may be made of resin-bonded sand in accordance with known mold practice wherein a mixture of sand or equivalent particles and bonding material is formed to shape and cured or hardened against a suitable pattern to form the desired slab ingate passages 24 and other features thereon. However, preferably, the drag slab 16 is formed of a high temperature ceramic material to permit reuse of the drag slab 16 in the countergravity casting of successive sets of casting molds 14 as will be explained hereinbelow. The use of a reuseable drag slab 16 carrying the expendable mold(s) 14 permits the use of less complex molds made from lesser quantities of mold materials and perchance cheaper materials which are not as thermally durable as those required when the casting mold itself is immersed in the melt.

The ceramic, molten metal filters 28 are preferably made of a porous, ceramic material (e.g., zirconia, alumina, etc.) resistant to the destructive effects of the molten metal 12 to be cast and having a pore size selected to remove non-metallic impurities such as oxide particles, slag particles, sand or ceramic mold particles, etc. having a size (e.g., diameter) greater than a given "harmful" size (i.e., an inclusion size adversely affecting part performance) from the molten metal 12 as it is drawn upwardly through each slab ingate passage 24 and the molten metal filter 28 therein as will be explained. Typically, the "harmful" size of inclusion-forming impurities to be removed from the molten metal 12 (and thus the required pore size of the filters 28) will depend on the configuration and dimensions, including the minimum wall thickness, of the part to be cast, the type of metal to be cast as well as the intended service conditions to be encountered by the cast part and can be determined empirically based on the performance of particular cast parts in appropriate tests and/or actual service. Those skilled in the art will appreciate that various types of molten metal filters may be used in practicing the invention.

As shown best in FIGS. 1 and 2, the casting molds 14 are spaced apart laterally in a rectangular pattern such that each casting mold 14 overlies a respective underlying slab ingate passage 24 and the molten metal filter 28 therein. Each casting mold 14 comprises a porous, gas permeable upper mold portion (mold cope) 32 and a lower mold portion (mold drag) 34, which may be gas permeable or impermeable. The upper and lower mold portions 32,34 may be adhesively engaged together along juxtaposed surfaces that define a parting plane or line 36, although the upper and lower mold portions 32,34 can be engaged together by various other means without adhesive.

The lower mold portion (mold drag) 34 of each mold 14 includes a bottom side 40 supported on the top side 20 of the drag slab 16.

Defined between the upper and lower mold portions 32,34 of each casting mold 14 is a mold cavity 42 formed at least in part in the gas permeable upper mold portion (mold cope) 32 and configured to form the desired cast part when the molten metal 12 is cast and solidified therein. In particular, each mold cavity 42 will include an internal thickness dimension t generally corresponding to the thickness of the part to be cast (taking into consideration the extent of shrinkage of the metal being cast). The invention is especially useful, although not limited to, the casting of the molten metal 12 into mold cavities 42 having an internal thickness t of about 0.5 inch or less to produce thin-walled cast parts of similar thickness.

Each mold cavity 42 is filled with the molten metal 12 from the pool 13 through a plurality of mold ingate passages 44 extending between the bottom side 40 of each casting mold 14 and the mold cavity 42 thereabove. The mold ingate passages 44 are cooperatively registered or aligned with the respective underlying slab ingate passage 24 and the molten metal filter 28 therein to receive filtered molten metal 12 during casting.

The upper and lower mold portions 32,34 of each casting mold 14 described hereinabove can be made of resin-bonded sand in accordance with the same procedure set forth above for making a resin-bonded drag slab 16.

The gas permeable casting molds 14 are enclosed within a vacuum chamber 50 defined by a vacuum housing 52 sealingly disposed on the top side 20 of the drag slab 16. The vacuum chamber 50 is communicated to a vacuum source 56 (e.g., a vacuum pump) through a conduit 58 sealingly connected to the upper ceiling 60 of the housing 52 so that the mold cavities 42 can be simultaneously evacuated through the gas permeable upper mold portion (mold cope) 32 when the bottom side 18 of the drag slab 16 is immersed in the molten metal pool 13. The housing 52 includes a peripheral wall 62 depending from the ceiling 60 and having a bottom lip 66 defining a mouth 50*a* of the vacuum chamber 50. An annular, sealing gasket 64 is carried on the bottom lip 66 of the peripheral wall 62 to sealingly engage the top side 20 of the drag slab 16. The vacuum housing 52 and the drag slab 16 can be held together with the sealing gasket 64 sealingly compressed therebetween by known clamping means.

In operation with the casting molds 14, drag slab 16 and the vacuum housing 52 cooperatively assembled as shown in FIG. 1, the drag slab 16 is lowered toward the molten metal pool 13 to immerse the entire bottom side 18 of the drag slab 16 in the molten metal pool 13 to simultaneously position the slab ingate passages 24 directly in the molten metal pool 13 and the vacuum source 56 is then actuated to provide a reduced pressure (subambient pressure) in the vacuum chamber 50 and thus in the mold cavities 42 (through the gas permeable upper mold portions 32). The subambient pressure established in the mold cavities 42 is sufficient to draw the molten metal 12 upwardly through each slab ingate passage 24 and the ceramic molten metal filter 28 therein and through the mold ingate passages 44 registered thereabove into each mold cavity 42 to fill the mold cavities 42 simultaneously with the molten metal 12. As the molten metal 12 is urged upwardly by evacuation of the mold cavities 42, the ceramic filters 28 in the slab ingate passages 24 trap and remove inclusion-forming impurities having a size greater than the selected pore size of the ceramic filters 28 from the molten metal 12 drawn into and filling the mold cavities 42. In this way, non-metallic inclusions of "harmful" size are minimized in the parts cast in the mold cavities 42.

During immersion of the drag slab 16 in the molten metal pool 13 the upstanding levee 22 isolates the cope-to-drag seal (i.e., parting plane 36) and the vacuum housing-to-mold sealing gasket 64 from the underlying molten metal pool 13 in accordance with U.S. Pat. No. 4,745,962 issued May 24, 1988 of common assignee herewith.

Moreover, since the molten metal filters 28 are glued in the seats 27 in the top side 20 of the drag slab 16 remote from the molten metal pool 13, the glue is protected from the heat of the molten metal pool 13 (thermally insulated and shielded from radiation from the pool 13) by the thickness of the material of the drag slab 16 therebelow to minimize thermal decomposition of the glue and resultant generation of gases which could become entrapped in the cast part.

Flow rate of the molten metal 12 into the casting molds 14 during countergravity casting is controlled to insure even (substantially constant), uninterrupted, controlled filling of each of the mold cavities 42 from the underlying molten metal pool 13. For example, the number, size and shape of the slab ingate passages 24, the mold ingate passages 44, and the pores or passages of the ceramic filter 28 are controlled to provide a desired even molten metal flow rate to quickly fill the mold cavities 42 without premature solidification of the molten metal therein and yet at the same time avoid erosion of the internal mold surfaces by the molten metal flowing into the mold cavities 42. Furthermore, a sump 70 of molten metal 12 may be provided above each ceramic filter 28 and beneath each mold cavity 42 (e.g., in the bottom side 40 of the lower mold portion 34 of each casting mold 14, see FIG. 3) to this same end. In particular, each molten metal sump 70 is positioned to provide an even (substantially constant), uninterrupted flow of the molten metal 12 to the mold cavity 42 thereabove in spite of gradual plugging of the molten metal filter 28 therebelow with inclusion-forming impurities removed from the molten metal drawn through the filter 28.

Preferably, the size of the mold ingate passages 44 is selected to effect initial solidification of the molten metal in the mold ingate passages 44 prior to solidification in the slab ingate passages 24 and the mold cavities 42 to permit withdrawal of the drag slab 16 from the molten metal pool 13 in a short time after filling of the mold cavities 42 with the molten metal 12. The number, size and spacing of the mold cavities 42 and the mold ingate passages 44 in each casting mold 14 will vary with the type of part to be cast and the particular metal to be cast as explained in U.S. Pat. No. 4,340,108, the teachings of which are incorporated herein by reference.

After the mold cavities 42 are filled with the molten metal 12 and at least the mold ingate passages 44 are solidified, the drag slab 16 is moved upwardly to remove its bottom side 18 from the molten metal pool 13. When the drag slab 16 is withdrawn from the molten metal pool 13 after mold filling, the molten metal in the slab ingate passages 24 will drain therefrom back into the pool 13 while the molten metal 12 as well as the impurities captured by the filters 28 will remain on/in the filters 28.

The metal-filled casting molds 14 are then separated from the drag slab 16 and transferred to a de-molding area where the molds 14 and solidified castings therein are separated in accordance with usual procedures. After the metal-filled casting molds 14 are removed from the drag slab 16, the used molten metal filters 28 are removed from the drag slab 16 and new molten metal filters 28 are positioned and glued in the seats 27 on the top side 20 of the drag slab 16. Thereafter, the drag slab 16 can be reused in casting another set of empty casting molds 14 by repeating the sequence of steps set forth hereinabove.

By employing a plurality of the expendable casting molds 14 carried on the reusable drag slab 16 having a slab ingate passage 24 and a molten metal filter 28 for supplying the filtered molten metal 12 through mold ingate passages 44 in a controlled manner to each mold cavity 42, the present invention provides an improved vacuum-assisted, countergravity casting apparatus and process which minimizes the presence of objectionable inclusions in the thin-walled cast parts without substantially adversely affecting the relatively high production rates and yields as well as other favorable economies achievable with this casting process.

To further improve production output and economies of the casting apparatus and process of the present invention, a plurality of vertically stacked casting molds 14 (not shown) can be positioned on the top side 20 of the drag slab 16 overlying each slab ingate passage 24 in the drag slab 16. Each casting mold in the stack would be interconnected to the mold 14 above it by one or more mold ingate passages so that all of the molds in each stack can be filled during countergravity casting with filtered molten metal from a common underlying slab ingate passage 24 having a molten metal filter 28 therein. In this way, the number of casting molds 14 which can be simultaneously, countergravity cast on the drag slab 16 is increased.

However, those skilled in the art will appreciate that the invention can be practiced using a single casting mold 14 positioned on the drag slab 16 and having a single mold cavity 42 or a plurality of mold cavities 42 formed therein.

Figure 3:
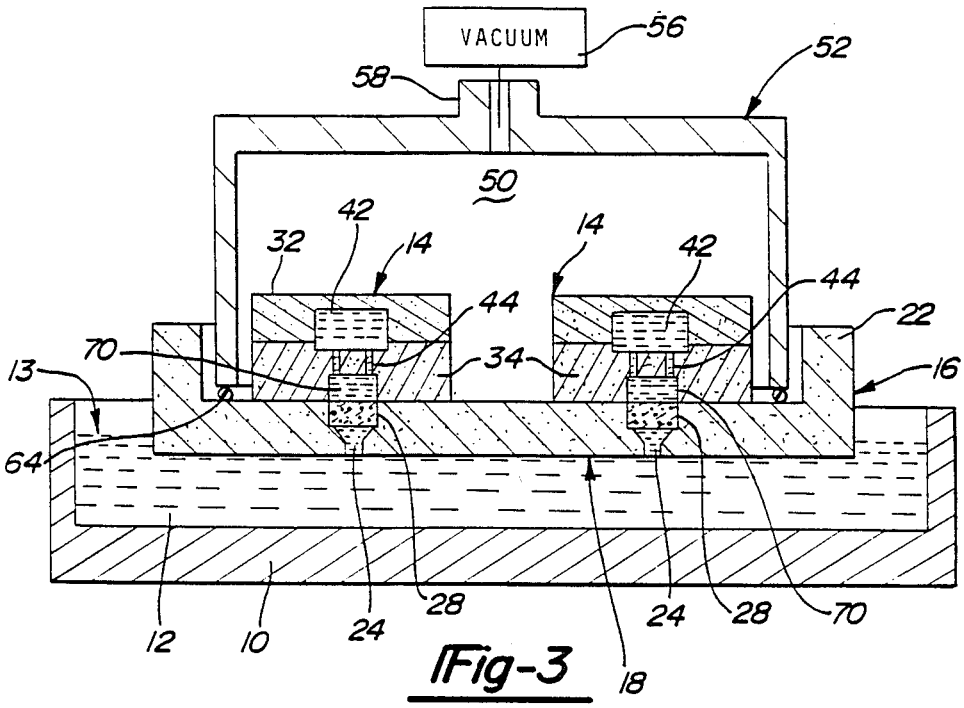
FIG. 3 is a sectioned elevational view of another embodiment of the casting apparatus similar to FIG. 1 but with a molten metal sump in each expendable casting mold above each molten metal filter.

Although FIGS. 1–3 illustrate a preferred casting apparatus of the invention as having an individual molten metal filter 28 positioned in each slab ingate passage 24, those skilled in the art will appreciate that a single molten metal filter 28 may be positioned in more than one of the slab ingate passages 24. The size, shape and arrangement of each molten metal filter 28 as well as the slab ingate passages 24 and the filter seats 27 on the drag slab 16 can be adapted to this end.

The following examples are offered to further illustrate the invention in more detail without in any way limiting the scope of the invention.

EXAMPLES

The subject invention was used to cast a plurality of ductile iron automobile connecting rods in a four-high stack of molds (i.e., one mold 14 atop the other). The lowermost mold 14 rested on a resin-bonded sand drag slab 16 with the mold ingate passages 44 of the lowermost mold aligned with the slab ingate passage 24 in the drag slab 16. The ingate passages 44 f each succeeding overlying mold 14 extended to the mold cavity 42 of the underlying mold 14 so as to receive a supply of melt from the mold thereunder. A $2\times2\times\frac{1}{2}$ inch ceramic, so called "cellular", filter 28 sold under the trademark CELTEX® (comprising 60% dordierite and 40% mullite) was placed in the recess 27 formed in the drag slab 16 such that a $\frac{1}{4}$ inch wide perimeter of the filter 28 rested on a shoulder in the recess 27, leaving a $1.5\times1.5$ square inch filter area through which the melt could flow. The filter 28 included 100 cells/pores per square inch and was capable of passing an initial flow rate of 6 to 8 lbs. of melt per second. Each mold cavity 42 had a melt capacity of 2.4 lbs./cavity. All four mold cavities were successfully filled with filtered melt at 2500° F. using a vacuum of 150 inches of water.

The aforesaid test was repeated using a so-called "sponge" filter 28 sold under the trademark SEDEX® positioned in the recess 27 formed in the drag slab 16. The SEDEX® filter comprised greater than 90% alumina and exhibited an open cell porosity of about 90% and an average pore size of about 0.080 inch. Connecting rods were successfully cast with the "sponge" filter under the same conditions as described immediately above.

While the invention has been described in terms of specific embodiments thereof, it is not intended to be limited thereto but rather only to the extent set forth hereafter in the claims which follow.

We claim:

1. An apparatus for the vacuum-assisted, countergravity casting of molten metal, comprising:

(a) a reuseable drag slab having a bottom side for immersion in an underlying pool of the molten metal, a top side, and a slab ingate passage between the bottom side and the top side, (b) an expendable gas permeable casting mold on the top side of the drag slab overlying said slab ingate passage, said casting mold including a bottom side supported on the top side of the drag slab, a mold cavity therein and a mold ingate passage disposed between the mold cavity and the bottom side of the casting mold and registered with said slab ingate passage therebelow for receiving molten metal therefrom, (c) means for relatively moving the drag slab and the molten metal pool to immerse the bottom side of the drag slab in the molten metal pool to position the slab ingate passage in the pool, and (d) a vacuum chamber confronting the casting mold for evacuating the mold cavity therein sufficiently to urge the molten metal upwardly through said registered slab and mold ingate passages into the mold cavity to fill the mold cavity with the molten metal.

2. The apparatus of claim 1 wherein the slab ingate passage includes a molten metal filtering means therein for removing inclusion-forming impurities from the molten metal as it is drawn upwardly through the slab ingate passage.

3. An apparatus for the vacuum-assisted, countergravity casting of molten metal, comprising:

(a) a drag slab having a bottom side for immersion in an underlying pool of the molten metal, a top side, and a plurality of laterally spaced apart slab ingate passages between the bottom side and the top side, (b) a plurality of gas permeable casting molds spaced apart laterally on the top side of the drag slab to overlie a respective slab ingate passage, each casting mold including a bottom side supported on the top side of the drag slab, a mold cavity therein and a mold ingate passage disposed between the mold cavity and the bottom side of the casting mold and registered with a respective slab ingate passage therebelow for receiving molten metal therefrom, (c) means for relatively moving the drag slab and the molten metal pool to immerse the bottom side of the drag slab in the molten metal pool to position the slab ingate passages in the pool, and (d) a vacuum chamber confronting the casting molds for evacuating the mold cavities therein sufficiently to urge the molten metal upwardly through each slab ingate passage and through the mold ingate passage registered therewith into each mold cavity to fill the mold cavities with the molten metal.

4. The apparatus of claim 3 wherein each slab ingate passage includes a molten metal filtering means therein for removing inclusion-forming impurities from the molten metal as it is drawn upwardly through each slab ingate passage.

5. The apparatus of claim 4 wherein each molten metal filtering means comprises a perforate, ceramic filter member.

6. The apparatus of claim 5 wherein each slab ingate passage includes an enlarged pocket to receive each molten metal filter.

7. The apparatus of claim 4 wherein a molten metal sump is disposed between each molten metal filtering means and a mold cavity thereabove.

8. The apparatus of claim 2 wherein each casting mold includes a drag portion having a bottom side supported on the top side of the drag slab and a cope portion supported on the drag portion.

9. The apparatus of claim 8 wherein the cope portion of each casting mold is gas permeable.

10. The apparatus of claim 9 wherein the mold cavity is at least in part defined in the gas permeable cope portion of each casting mold.

11. An apparatus for the countergravity casting of molten metal, comprising:

(a) a reusable drag slab having a bottom side for immersion in an underlying pool of the molten metal, a top side and a plurality of laterally spaced apart slab ingate passages between the bottom side and the top side, (b) a molten metal filter disposed in each slab ingate passage for removing inclusion-forming impurities from the molten metal as it is drawn through each slab ingate passage, (c) a plurality of expendable, gas permeable casting molds spaced apart laterally on the top side of the drag slab to overlie a respective slab ingate passage, each casting mold including a bottom side supported on the top side of the drag slab, a mold cavity therein and a mold ingate passage disposed between the mold cavity and the bottom side and registered with a respective slab ingate passage for receiving filtered molten metal therefrom, (d) means for relatively moving the drag slab and the molten metal pool to immerse the bottom side of the drag slab in the molten metal pool to position the slab ingate passages in the pool, and (e) a vacuum chamber sealingly disposed on the drag slab and confronting the casting molds for evacuating the mold cavities therein to urge the molten metal upwardly through each slab ingate passage and the molten metal filter therein and through the mold ingate passage registered therewith into each mold cavity to fill the mold cavities with the molten metal from which inclusion - forming impurities have been removed.

12. The apparatus of claim 11 wherein a molten metal sump is disposed between each molten metal filter and each mold cavity thereabove.

13. The apparatus of claim 11 wherein each casting mold includes a plurality of mold ingate passages registered with said respective slab ingate passage.

14. The apparatus of claim 11 wherein each casting mold includes a drag portion having a bottom side supported on the top side of the drag slab and a cope portion supported on the drag.

15. The apparatus of claim 14 wherein the cope portion of each casting mold is gas permeable.

16. The apparatus of claim 15 wherein the mold cavity is at least in part defined in the gas permeable cope portion of each casting mold.

17. A method for the countergravity casting of molten metal, comprising the steps of:

(a) providing a reusable drag slab having a slab ingate passage extending between a top side of the drag slab and a bottom side thereof that is adapted for immersion in an underlying molten metal pool, (b) positioning an expendable gas permeable casting mold on the top side of the drag slab overlying said slab ingate passage, including registering a mold ingate passage of said casting mold with said slab ingate passage for supplying the molten metal to a mold cavity above the mold ingate passage in said casting mold, (c) relatively moving the drag slab and the underlying molten metal pool to immerse the bottom side of the drag slab in the molten metal pool to position the slab ingate passage in the pool, (d) evacuating the mold cavity of the casting mold sufficiently to urge the molten metal upwardly through said slab ingate passage and said mold ingate passage registered therewith into said mold cavity to fill the mold cavity with the molten metal, (e) relatively moving the drag slab and the molten metal pool to remove the bottom side of the drag slab from the molten metal pool, and (f) separating the metal-filled casting mold and the drag slab and repeating steps (b), (c) and (d) with the same drag slab.

18. The method of claim 17 including filtering the molten metal as it is drawn upwardly through said slab ingate passage to remove impurities therefrom that could cause harmful inclusions in the cast part formed in the mold cavity.

19. The method of claim 18 wherein the molten metal is filtered in the slab ingate passage by drawing the molten metal upwardly through a perforate filtering means in said slab ingate passage.

20. A method for the countergravity casting of molten metal, comprising the steps of:

(a) providing a drag slab having a plurality of laterally spaced apart slab ingate passages extending between a top side of the drag slab and a bottom side thereof that is adapted for immersion in an underlying molten metal pool, (b) positioning a plurality of gas permeable casting molds on the top side of the drag slab with each casting mold overlying a respective slab ingate passage, including registering a mold ingate passage of each casting mold with a respective slab ingate passage for supplying the molten metal to a mold cavity above the mold ingate passage in each casting mold, (c) relatively moving the drag slab and the underlying molten metal pool to immerse the bottom side of the drag slab in the molten metal pool to position the slab ingate passages in the pool, and (d) evacuating the mold cavities of the casting molds sufficiently to urge the molten metal upwardly through each slab ingate passage and through each mold ingate passage registered therewith into each mod cavity to fill the mold cavities with the molten metal.

21. The method of claim 20 including after step (d), relatively moving the drag slab and the molten metal pool to remove the bottom side of the drag slab from the molten metal pool, separating the metal-filled casting molds and the drag slab and repeating steps (b), (c) and (d) with same drag slab.

22. The method of claim 20 including filtering the molten metal as it is drawn upwardly through each slab ingate passage to remove impurities therefrom that could cause harmful intrusions in the cast part formed in each mold cavity.

23. The method of claim 22 wherein the molten metal is filtered in each slab ingate passage by drawing the molten metal upwardly through a perforate filtering means in each slab ingate passage.

24. The method of claim 23 including after step (d), relatively moving the drag slab and the molten metal pool to remove the bottom side of the drag from the molten metal pool, separating the metal-filled casting molds and the drag slab, removing from each slab ingate passage the filtering means used to cast said metal-filled casting molds, positioning unused filtering means in each slab ingate passage, and repeating steps (b), (c) and (d) with same drag slab.

25. The method of claim 20 wherein the mold cavities of the casting molds are simultaneously evacuated.

26. The method of claim 22 wherein the mold cavity of each casting mold is configured to have a thickness of about 0.5 inch or less.

* * * * *

UNITED STATES PATENT AND TRADEMARK OFFICE

CERTIFICATE OF CORRECTION

PATENT NO. : 4,865,113

DATED : September 12, 1989

INVENTOR(S) : Karl D. Voss, James B. Mercer and Gary F. Ruff

It is certified that error appears in the above-identified patent and that said Letters Patent is hereby corrected as shown below:

Column 12, line 5, change "mod" to --mold--.

Signed and Sealed this

Nineteenth Day of March, 1991

*Attest:*

HARRY F. MANBECK, JR.

*Attesting Officer*

*Commissioner of Patents and Trademarks*